US009057134B2

(12) United States Patent
Andreoli et al.

(10) Patent No.: US 9,057,134 B2
(45) Date of Patent: Jun. 16, 2015

(54) PROCESS FOR THE STRIPPING OF WORKPIECES AND STRIPPING SOLUTION

(75) Inventors: Tamara Andreoli, Balzers (LI); Udo Rauch, Sclins (AT)

(73) Assignee: OERLIKON SURFACE SOLUTIONS AG, TRUBBACH, Trubbach (CH)

( * ) Notice: Subject to any disclaimer, the term of this patent is extended or adjusted under 35 U.S.C. 154(b) by 226 days.

(21) Appl. No.: 12/989,727

(22) PCT Filed: Apr. 9, 2009

(86) PCT No.: PCT/EP2009/002631

§ 371 (c)(1),
(2), (4) Date: Oct. 26, 2010

(87) PCT Pub. No.: WO2009/132758

PCT Pub. Date: Nov. 5, 2009

(65) Prior Publication Data

US 2011/0056914 A1 Mar. 10, 2011

Related U.S. Application Data

(60) Provisional application No. 61/049,890, filed on May 2, 2008.

(51) Int. Cl.

| | |
|---|---|
| ***C23F 1/36*** | (2006.01) |
| ***C23F 1/44*** | (2006.01) |
| ***C23F 1/38*** | (2006.01) |
| ***C23G 1/20*** | (2006.01) |
| ***C23G 1/22*** | (2006.01) |

(52) U.S. Cl.
CPC ... *C23F 1/44* (2013.01); *C23F 1/36* (2013.01); *C23F 1/38* (2013.01); *C23G 1/205* (2013.01); *C23G 1/22* (2013.01)

(58) Field of Classification Search
None
See application file for complete search history.

(56) References Cited

U.S. PATENT DOCUMENTS

| | | | | |
|---|---|---|---|---|
| 3,085,917 | A | 4/1963 | Netzler et al. | |
| 3,833,414 | A | 9/1974 | Grisik et al. | |
| 4,327,134 | A | 4/1982 | Baldi | |
| 5,128,179 | A | 7/1992 | Baldi | |
| 5,700,518 | A | 12/1997 | Lee et al. | |
| 6,036,995 | A * | 3/2000 | Kircher et al. | 427/142 |
| 2004/0118805 | A1 * | 6/2004 | Hareland et al. | 216/13 |
| 2005/0241679 | A1 | 11/2005 | Rauch et al. | |
| 2006/0182892 | A9 * | 8/2006 | Spitsberg et al. | 427/404 |
| 2007/0018164 | A1 * | 1/2007 | Ishikawa | 257/59 |

FOREIGN PATENT DOCUMENTS

| | | | |
|---|---|---|---|
| DE | 1446423 | A | 3/1969 |
| DE | 2339608 | A | 3/1974 |
| DE | 4339502 | A1 | 6/1995 |
| EP | 0090512 | A1 | 10/1983 |
| EP | 1029117 | A | 8/2000 |
| FR | 1369568 | A | 8/1964 |
| WO | 99/24642 | A1 | 5/1999 |
| WO | 2005/073433 | A | 8/2005 |

OTHER PUBLICATIONS

International Search Report for PCT/EP2009/002631 dated Jul. 15, 2009.
Written Opinion for PCT/EP2009/002631 dated Jul. 15, 2009.

* cited by examiner

*Primary Examiner* — Shamim Ahmed
*Assistant Examiner* — Bradford Gates
(74) *Attorney, Agent, or Firm* — Pearne & Gordon LLP

(57) ABSTRACT

A material mixture for dissolving a coating system from a work piece comprises an aqueous, alkaline solution containing between 3 and 8 weight percent $KMnO_4$ and at the same time having an alkaline fraction of between 6 and 15 weight percent. The alkaline fraction is formed in one embodiment by KOH or NaOH, wherein the pH of the solution is above 13. A method according to the present invention uses the above-described material mixture for wet-chemical delaminating of hard material coatings of the group: metallic AlCr, TiAlCr and other AlCr alloys; nitrides, carbides, borides, oxides thereof and combinations thereof.

6 Claims, No Drawings

PROCESS FOR THE STRIPPING OF WORKPIECES AND STRIPPING SOLUTION

The present invention concerns the field of the chemical wet stripping of workpieces, especially tools and components coated with a hard film. Special emphasis is attached to the stripping of hard films containing oxides, especially chrome aluminium oxides (AlCrO films).

BACKGROUND OF THE INVENTION

In metalworking, it has long been customary to use coated tools since they are superior to uncoated tools in many of their properties: higher operating temperatures, higher cutting speeds, longer tool-life, edge stability, corrosion resistance, etc. However, films optimized for wear protection and hardness are also used on other components which are exposed to comparable conditions in use and consequently require the same kind of properties; bearing parts and components for the automobile industry such as coated pistons, injection nozzles, etc., are examples of these.

Another aspect of coating is the problem of stripping, in particular for parts whose coating is flawed or—in the case of tools—which have to be stripped, reworked and coated once more.

The manifold service requirements result in a whole series of specialized coating and coating systems which in turn involve various stripping requirements. Stripping should be economical (rapid, only simple apparatus, low-priced consumer materials, usable for as many coatings as possible), safe (as few dangerous substances as possible), environmentally friendly and, not least, the coated tool or component should not be damaged by the stripping procedure.

STATE OF THE ART

From the state of the art, a large number of formulations are known for wet chemical stripping processes and solutions, especially for coatings containing titanium such TiN, TiCN or TiAlN. These are mostly based on hydrogen peroxide with a stabilizer. EP 1 029 117 proposes a stripping process in which hydrogen peroxide, a base and at least one acid or the salt of an acid are used.

Patent application DE 4339502 describes the non-destructive stripping of hard-metal substrates, coated among other things with TiAlN-films. It is stated that the advantages in comparison with earlier processes are that in addition to the usual complexing agents, stabilizers and inhibitors for corrosion protection, also other process materials are used and the solution is set to a pH-value which, in conjunction with the other reagents, prevents a dissolving out of Co from the workpiece. The disadvantages of this solution are the comparatively long stripping time for TiAlN and other coatings, the relatively high quantity of chemicals used and the costs associated with that, the relatively complicated formulations (and reaction conditions (since they must be meticulously observed) and the use of reagents containing fluorine.

In WO 2005/073433, for the improvement of the stripping behavior, it is proposed to apply a layer containing chrome or aluminum to a substrate and to strip the workpiece with an alkaline solution containing a powerful oxidizing agent, e.g., a permanganate solution. In particular, if it is desired to strip sensitive hard metals in an unduly alkaline milieu, it is proposed that a pH-value of about 7 be set for high permanganate concentrations of some 20 to 50 g/l in order to detach the films. For the stripping of workpieces such as steel substrates and many other ferrous alloys resistant to alkaline solutions, a higher pH-range between 9 and 14 is recommended whereby a lower permanganate concentration, e.g., between 10 and 30 g/l, is sufficient to achieve a complete stripping of AlCrN films of 2 to 10 μm thickness even at room temperature (about 15 to 30° C.) within 15 to 60 minutes. With a permanganate concentration of more than 30 g/l, it is stated that stripping takes place even more quickly.

PURPOSE OF THE INVENTION

In practice, it has emerged that the solutions proposed in WO 2005/073433, e.g., Example 5 with the main constituents 20 g/l NaOH and 20 g/l $KMnO_4$, are not optimal for modern AlCrN films such as Balinit Alcrona known to the market. Since these films allow a maximum application temperature of more than 1000° C., it is surmised, depending on the actual use, that oxygen is included in the AlCrN film and this is then compressed. A noticeable deterioration in the stripping action then occurs.

Essentially the same problem occurs with AlCrO films (aluminium-chrome oxide) which cannot be stripped at all with a solution as described in Example 5 above.

Furthermore, it was also known that on account of the sensitivity of hard metals to highly alkaline solutions it was not possible to obtain an economical, universal stripping solution for steels and hard metals for this area of hard films.

The purpose of the invention is to describe a stripping process or a stripping solution which allows the removal in an economical manner of hard films of at least AlCr, AlCrN and/or AlCrO from a workpiece without substantially damaging the actual workpiece.

DESCRIPTION OF THE INVENTION

In accordance with the invention, this problem is solved by a mixture of substances for the stripping of a film system from a workpiece whereby the mixture of substances can be prepared as an aqueous, alkaline solution with 3 to 8 percent in weight $KMnO_4$, preferably between 3 and 5 percent in weight $KMnO_4$, and at the same time displays an alkaline proportion between 6 and 15 percent in weight, preferably between 6 and 12 percent in weight. In a preferred version, the solution contains 4 percent in weight $KMnO_4$, whereby at the same time the alkaline proportion is between 8 and 11 percent in weight and preferably at 10 percent in weight. The alkaline proportion in one version is formed by KOH or NaOH whereby the pH-value of the solution is above 13 and preferably above 13.5 percent in weight.

A workpiece to be subjected to a process in accordance with the invention displays a film system on the workpiece which comprises at least one film which in turn displays one of the following materials: metallic AlCr, TiAlCr and other AlCr alloys; or one of their nitrides, carbides, borides, oxides or a combination of these and aluminium oxides. The process in accordance with the invention for the stripping of a film system provides for the workpiece to be placed in a stripping solution in accordance with the description above and to treat it there for a predetermined period of time. The solution may be moved during the treatment, e.g., by stirring or by moving the workpiece. The treatment is preferably carried out at room temperature, e.g., between 15 and 30° C., but is also possible at higher temperatures, e.g., up to 60 or 70° C.

Provision may also be made for pre- and post-treatment steps, including chemical or mechanical surface treatments, for example. These include at least one of the following possible treatments: rinsing, cleaning, ultrasound, drying, irradiation, brushing, heat treatment.

EXPERIMENTAL RESULTS

Various abbreviations are used in the following. The materials 1.2379, ASP2023 (1.3343), 1.2344, SDK (1.3344) and QRS (1.2842) designate various steel qualities including high-alloy steels and high-speed steels. TTX, THM and TTR designate indexable inserts of tungsten carbides of varying composition. "Helica" refers to an AlCr-based film material known on the market under the tradename of Balinit® Helica. "Alcrona" designates an AlCrN coating marketed as Balinit® Alcrona.

The following have been used as stripping solutions:

- a state-of-the-art solution as described above with 2% $KMnO_4$ and 2% NaOH, designated below as: 2K/2Na
- a first solution in accordance with the present invention with 4% $KMnO_4$ and 10% NaOH, designated below as: 4K/10Na
- a second solution in accordance with the present invention with 4% $KMnO_4$ and 10% KOH and, designation in following 4K/10K Test 1: Effectiveness Number of test specimens which could be fully stripped in 50 mL solution in each case.

TABLE 1

| solution: | workpiece/material of test specimen: | stripped: |
|---|---|---|
| 2K/2Na | SDK | 11 |
| 4K/10Na | SDK | 27 |
| 4K/10K | SDK | 28 |
| 2K/2Na | THM | 6 |
| 4K/10Na | THM | 11 |
| 4K/10K | THM | 12 |

Test 2: Influence on Substrate

Another important criterion is the extent to which a solution attacks the surface of the base material or workpiece in question. The following tables state what surface composition was displayed by uncoated test specimens that were exposed for one hour to the solution in question. For comparison, values of a 2K/2Na solution are also given. The content of certain elements in the surface of the test specimen was measured by EDX (energy dispersive X-ray spectroscopy, a material analysis procedure).

Solution 2K/2Na. All details in Wt %

TABLE 2

| | Si | Mn | Cr | Mo | V | W | Fe |
|---|---|---|---|---|---|---|---|
| SDK | 0.41 | 0.48 | 4.14 | 4.97 | 1.67 | 9.58 | 78.74 |
| QRS | 0.37 | 2.55 | 0.58 | | 0.27 | | 96.24 |
| ASP2023 | 0.72 | 0.85 | 4.27 | 3.35 | 1.97 | 6.42 | 82.43 |
| 1.2379 | 0.65 | 0.5 | 11.83 | 1 | 1.09 | | 84.93 |
| 1.2344 | 1.13 | 0.55 | 5.41 | 1.49 | 1.07 | | 90.35 |

Solution 4K/10K. All details in Wt %

TABLE 3

| | Si | Mn | Cr | Mo | V | W | Fe |
|---|---|---|---|---|---|---|---|
| SDK | 0.35 | 0.39 | 4.07 | 3.33 | 1.32 | 6.73 | 83.81 |
| QRS | 0.41 | 2.33 | 0.68 | | 0.38 | | 96.2 |
| ASP2023 | 0.72 | 0.52 | 4.18 | 2.5 | 1.35 | 5.99 | 84.75 |

TABLE 3-continued

| | Si | Mn | Cr | Mo | V | W | Fe |
|---|---|---|---|---|---|---|---|
| 1.2379 | 0.71 | 0.97 | 8.13 | 0.78 | 0.71 | | 88.7 |
| 1.2344 | 1.13 | 0.55 | 5.18 | 1.26 | 0.95 | 3.49 | 87.44 |

Solution 4K/10Na. All details in Wt %

TABLE 4

| | Si | Mn | Cr | Mo | V | W | Fe |
|---|---|---|---|---|---|---|---|
| SDK | 0.2 | 0.68 | 3.96 | 3.16 | 1.27 | 7.17 | 83.56 |
| QRS | 0.4 | 2.17 | 0.49 | | 0.19 | | 96.76 |
| ASP2023 | 1.4 | 0.89 | 3.87 | 2.59 | 1.53 | | 89.72 |
| 1.2379 | 0.67 | 0.41 | 7.78 | 0.69 | 0.47 | | 89.98 |
| 1.2344 | 1.02 | 0.6 | 5.48 | 1.27 | 1.07 | 0.85 | 89.71 |

Solution 2K/2Na. All details in Wt %

TABLE 5

| | W | Co | Ti | Ta |
|---|---|---|---|---|
| THM | 91.74 | 8.26 | | |
| TTX | 42.41 | 24.18 | 19.27 | 14.15 |
| TTR | 42.97 | 39.84 | 8.04 | 9.15 |

Solution 4K/10K. All details in Wt %

TABLE 6

| | W | Co | Ti | Ta |
|---|---|---|---|---|
| THM | 81.12 | 18.88 | | |
| TTX | 56.62 | 22.02 | 13.02 | 8.33 |
| TTR | 28.72 | 53.08 | 10 | 8.2 |

Solution 4K/10Na. All details in Wt %

TABLE 7

| | W | Co | Ti | Ta |
|---|---|---|---|---|
| THM | 72.45 | 27.55 | | |
| TTX | 33.6 | 34.86 | 17.47 | 14.07 |
| TTR | 9.48 | 64.57 | 11.63 | 14.31 |

Test 3: Stripping Times

The stripping times under standardized, comparable conditions were determined for various test specimens and different films for this. The Table shows in what time (minutes) a 4 μm thick film is completely removed from the workpiece. All figures in minutes:

TABLE 8

| solution | Helica SDK | Helica THM | Alcrona SDK | Alcrona THM | Aluminium oxide |
|---|---|---|---|---|---|
| 2K/2Na | 83 | 347 | 31 | 31 | ./. |
| 4K/10Na | 31 | 136 | 12 | 26 | 93 |
| 4K/10K | 26 | 90 | 12 | 19 | 130 |

Test 4: Stripping of WC/C

Test specimens (pistons) with a 0.8 μm tungsten carbide film with a high carbon content were stripped with 4K/10Na and 4K/10K. After 12 hours' exposure to 4K/10K, the test specimen was stripped but that exposed to 4K/10Na not yet.

Test 5: Removal in the Case of Hard Metal

The test specimens (double-lip hard-metal milling cutter dia. 8 mm, Alcrona film) were exposed to the stripping solution for 30 min and then blasted with F500 blast medium at 3 bar. The material removed was measured in μm. The tool was then recoated, stripped, measured, etc. The following table shows the material removed in μm.

TABLE 9

| solution | 1 x stripping and blasting | 5 x stripping and blasting |
|---|---|---|
| 2K/2Na | 2 | 11 |
| 4K/10K | 4.5 | 12 |
| 4K/10Na | 5.5 | 15 |

Result:

Conventional hard metals or sintered carbide metals consist of 90-94% tungsten carbide as a reinforcement phase and 6-10% cobalt as a binding agent/binding phase. During the binding process, due to its lower melting point (in comparison with the carbide), the binding agent melts and binds the carbide grains. There are material variations that in addition to tungsten carbide also contain TiC (titanium carbide), TiN (titanium nitride) or TaC (tantalum carbide) with a binding phase of Ni, Co or Mo. Examples of these hard metals designated as cermets are the TTX and TTR materials (TTX: 60% WC, 31% TiC+Ta(Nb)C+9% Co) listed in this application. In the stripping process, it is therefore the retention of the binding phase which is especially critical; the stripping solution must not dissolve the actual tool. This is why it is also advised in the state of the art to avoid a strongly alkaline milieu when stripping hard metal films from hard metals.

As demonstrated in the above tests and despite the prejudice of the professionals that hard metals should not be exposed to strongly alkaline stripping solutions, such a solution is specified. 4K/10Na and 4K/10K both have a pH-value of more than 13 and nevertheless affect the cobalt binding phase in the hard metal test specimens very much less as shown in Tables 4 and 5, except in one case (TTX at 4K/10K), than the 2K/2Na solution according to the state of the art.

Table 7 shows that the first time that the 4K/10Na and 4K/10K solutions are used there is indeed a more marked removal of material from the substrate than with the solution according to the state of the art. Over a period of time, however, it is apparent that the 4K/10K solution in particular causes only a very slightly higher removal of material than 4K/10Na. This is astonishing since the high content of potassium hydroxide should attack the base material more aggressively than the otherwise comparable solution with sodium hydroxide.

The following hypothesis could possibly explain this: during the preparation of the 4K/10K solution, green crystals appear in the fresh solution and are a sign that manganate (VI) has been formed through reaction in the permanganate solution with much alkali hydroxide. These crystals dissolve again when the stripping solution is used.

It may therefore be surmised that permanganate is thus withdrawn from a fresh solution by the reaction to manganate (VI) which reduces the higher aggressiveness of 4K/10K actually expected by the expert. During use, the manganate (VI) manganate (VI) crystals are again dissolved, are immediately available in the solution as an oxidation agent on the one hand while on the other a further conversion to permanganate can also take place in the potassium hydroxide solution. In other words, the 4K/10K stripping solution regenerates itself in use. This hypothesis is supported by the experimental findings in Table 7 and also in Table 1.

When used on steel, the picture is not so consistent but here, too it is to be noted that the solutions in accordance with invention are selectively less aggressive than would be expected from the chemical composition.

As regards effectiveness, Table 1 shows that the solutions in accordance with invention are twice as effective on average and allow very much shorter exposure times (Table 6).

It is known that manganese dioxide is precipitated from the permanganate solution during the stripping process. From case to case, it may therefore be necessary to remove MnO2 residues from the workpiece surface after chemical wet stripping. This can be carried out in a known manner with an ultrasonic bath whereby for support a weak acid or a buffer solution in the acidic to slightly alkaline ranges can be used for a postprocessing step.

What is claimed is:

1. Process for the stripping of a film system from a workpiece whereby the film system on the workpiece comprises at least one film comprising an oxide of AlCr, TiAlCr and other AlCr alloys; and aluminium oxides, characterized in that the workpiece is placed in a stripping solution and remains there for treatment for a predetermined time suitable to substantially remove the film system from the workpiece without damaging the workpiece, wherein the stripping solution comprises:

an aqueous, alkaline solution with potassium permanganate $KMnO_4$, characterized in that the solution comprises between 3 and 8 percent in weight $KMnO_4$ and at the same time an alkaline content of the solution is between 6 and 15 percent in weight.

2. Process as in claim 1, characterized in that the stripping solution is at a temperature between 15 and 30° C.

3. Process as in claim 1 or 2, characterized in that in addition at least one postprocessing step is provided after the workpiece is placed in the stripping solution, wherein the postprocessing step comprises a surface treatment of the workpiece.

4. Process as in claim 1 or 2, characterized in that in design at least one pretreatment step before the workpiece is placed in the stripping solution, wherein the at least one pretreatment step comprises a surface treatment of the workpiece.

5. Process as in claim 3, characterized in that the surface treatment is at least one of the following possible treatments: rinsing, cleaning, ultrasound, drying, irradiation, brushing, heat treatment.

6. The process of claim 3, wherein the workpiece is a metallic workpiece, the process being characterized in that the film system is exposed to the stripping solution applied to the metallic workpiece.

* * * * *